US007998387B2

(12) United States Patent
Jaarsveld et al.

(10) Patent No.: US 7,998,387 B2
(45) Date of Patent: Aug. 16, 2011

(54) PROCESS FOR PRODUCING A PLURALITY OF HIGH-STRENGTH, HIGH MODULUS AROMATIC POLYAMIDE FILAMENTS

(75) Inventors: Michiel Jan Adriaan Jaarsveld, Utrecht (NL); Theodorus Hendrikus Van Workum, Westervoort (NL)

(73) Assignee: Teijin Aramid B.V., Arnhem (NL)

( * ) Notice: Subject to any disclaimer, the term of this patent is extended or adjusted under 35 U.S.C. 154(b) by 0 days.

(21) Appl. No.: 13/057,054

(22) PCT Filed: Jul. 21, 2009

(86) PCT No.: PCT/EP2009/059324

§ 371 (c)(1),
(2), (4) Date: Feb. 1, 2011

(87) PCT Pub. No.: WO2010/023037

PCT Pub. Date: Mar. 4, 2010

(65) Prior Publication Data

US 2011/0140301 A1 Jun. 16, 2011

(30) Foreign Application Priority Data

Aug. 29, 2008 (EP) ..... 08163291

(51) Int. Cl.
*D01D 5/06* (2006.01)
*D01F 6/60* (2006.01)

(52) U.S. Cl. ..... 264/180; 264/184

(58) Field of Classification Search ..... 264/180, 264/181, 183, 184
See application file for complete search history.

(56) References Cited

U.S. PATENT DOCUMENTS

| | | | |
|---|---|---|---|
| 4,298,565 | A | 11/1981 | Yang |
| 4,340,559 | A | 7/1982 | Yang |
| 4,869,860 | A | 9/1989 | Lewis, Jr. |
| 4,898,704 | A | 2/1990 | Luckey |
| 4,965,033 | A | 10/1990 | Chiou |

FOREIGN PATENT DOCUMENTS

| | | |
|---|---|---|
| JP | A-3-113008 | 5/1991 |

OTHER PUBLICATIONS

Nov. 13, 2009 International Search Report issued in International Application No. PCT/EP2009/059324.
Nov. 13, 2009 Written Opinion issued in International Application No. PCT/EP2009/059324.

*Primary Examiner* — Leo B Tentoni
(74) *Attorney, Agent, or Firm* — Oliff & Berridge, PLC

(57) ABSTRACT

A process for producing a plurality of high strength, high modulus aromatic polyamide filaments that includes extruding an acid solution containing at least 15% by weight of an aromatic polyamide through linearly arranged orifices in a spinneret to provide a warp of filaments, passing the warp of filaments through a layer of non-coagulating fluid into a coagulation bath and subsequently passing the warp through a spin tube, the spin tube having an elongated cross section with at least two opposite sides being parallel to the filament warp with the length of these sides being at least as long as the width of the filament warp, jetting additional coagulating liquid at a constant flow rate about the filaments in a downward direction at an angle between 15° and 75° with respect to the filaments, the jetted coagulating liquid moving downward with the warp of filaments through the spin tube at a velocity of about 50% to 100% of the velocity of the filaments, the coagulating liquid being jetted through a jet channel from either one side of the spin tube which is parallel to the filament warp, and the jet channel having at least the same width as the filament warp.

10 Claims, No Drawings

PROCESS FOR PRODUCING A PLURALITY OF HIGH-STRENGTH, HIGH MODULUS AROMATIC POLYAMIDE FILAMENTS

The invention pertains a process for producing high strength, high modulus aromatic polyamide filaments.

Such processes are known in the art. Initially the acid solution of aromatic polyamides was extruded into a non-coagulating fluid e.g. air and then into a shallow bath of coagulating fluid e.g. water and out through an orifice at the bottom of the bath. Further developments were aimed at increasing the spinning speed leading to an higher output thus making the process more efficient. However, yarn quality deteriorates with increasing spinning speed. Even worse, sometimes spinning speeds need to be lowered for the delicate thin yarns. This is reducing the capacity even further.

It has been recognized that high spinning speeds create a significant friction between the filaments and the coagulating liquid due to the large difference in velocity between the filaments and the coagulating liquid thus leading to a decrease in filament properties, e.g. breaking tenacity.

U.S. Pat. No. 4,869,860 discloses an improved process for the production of aromatic polyamide filaments. After extrusion the polymer solution passes vertically downward into a gravity accelerated and free falling coagulating liquid. Although the velocity difference between filaments and coagulating liquid is reduced the spinning speed is still limited by the fact that the velocity of the coagulating liquid cannot be increased above the velocity reached through gravity acceleration.

Consequently, U.S. Pat. No. 4,898,704 discloses a process for producing high strength, high modulus aromatic polyamide filaments by coagulating a warp of filaments from a linear spinneret by delivering a jetted sheet of coagulating liquid equally and uniformly along each side of the warp. The jetting of coagulating liquid further reduces relative filament to coagulating liquid speeds The jets are located on each side of the warp, the jet coagulator thus showing a symmetric configuration. Due to the symmetrical layout of the jets the filaments are not forced together and do not come into contact with any solid or mechanical surfaces until after being coagulated.

U.S. Pat. No. 4,298,565 discloses an improved process for preparing high strength, high modulus aromatic polyamide filaments in which an acid solution containing at least 30 g/100 ml acid of an aromatic polyamide is extruded through a spinneret into a layer of noncoagulating fluid and then into a coagulating bath to form filaments which are passed through a spin tube aligned with the spinneret. Additional coagulating liquid is jetted symmetrically about the filaments along a downward direction forming an angle of 0° to 85° with respect to the filaments. The velocity of the jetted coagulating liquid may be as much as 150% that of the yarn, preferably it does not exceed about 85% of the yarn velocity. The improvements in the yarns properties are not observed unless the spinneret, spin tube, jets, and extension of the spin tube are carefully aligned on the same axis and unless the jet elements are carefully designed and aligned to provide perfectly symmetrical jetting about the threadline.

Symmetrical jetting is considered necessary in order to achieve filaments with the desired properties at high spinning speeds, to avoid inhomogeneous coagulating conditions at the individual filaments and to avoid sticking of the filaments to the spin tube wall or to each other.

It is therefore an object of the present invention to provide an alternative to the prior art processes employing a symmetric jet coagulator that allows high speed spinning of high strength, high modulus aromatic polyamide filaments with simpler and thus cost efficient process layout.

This object is achieved with a process for producing a plurality of high strength, high modulus aromatic polyamide filaments comprising the steps of

- extruding an acid solution containing at least 15% by weight of an aromatic polyamide through linearly arranged orifices in a spinneret thus providing a warp of filaments
- passing the warp of filaments through a layer of non-coagulating fluid into a coagulation bath and subsequently
- passing the warp through a spin tube, the spin tube having an elongated cross section with at least two opposite sides being parallel to the filament warp with the length of these sides being at least as long as the width of the filament warp,
- jetting additional coagulating liquid at a constant flow rate about the filaments in a downward direction at an angle between 15° and 75° with respect to the filaments,
- the jetted coagulating liquid moving downward with the warp of filaments through the spin tube at a velocity of about 50% to 100% of the velocity of the filaments, the coagulating liquid being jetted through a jet channel from either one side of the spin tube which is parallel to the filament warp, the jet channel having at least the same width as the filament warp.

In accordance with known procedures the filaments are deflected, washed and/or neutralized and dried before wind up of yarns produced by the process.

Aromatic Polyamide

The term "warp" as used herein means an array of filaments aligned side by side and essentially parallel.

The process according to the invention makes use of an asymmetric jet configuration. Coagulating liquid is jetted about the filaments only on one side of the filaments. In a jet coagulator, coagulation liquid, preferably water or aqueous solutions, is jetted along with the yarn. By doing this, the water/yarn friction is reduced, and therefore yarn tension. Also, by carefully choosing the jet angle the suction from the coagulator bath can be controlled. This gives control over bath stability. Also, the jet can be used to suck the yarn in during thread-up.

Although the prior art indicates otherwise, it could surprisingly be found that the process according to the invention with an asymmetric jet configuration in combination with a linear spinneret leads to high strength, high modulus aromatic polyamide filaments with no loss in properties even at high spinning speeds. The asymmetric jet configuration is sufficient to envelop the individual filaments with coagulating liquid and to prevent sticking of the filaments to the spin tube wall as well as to other filaments. The process according to the invention allows a simpler construction of the coagulating unit as only one jet is required which makes manufacturing much easier and therefore reduces costs. The use of only one jet instead of two or even a plurality of symmetrically aligned jets also reduces the clogging risk at the jet outlet channel since the height of the jet channel may be increased in order to obtain similar velocities in the tube. Provided that spin tube cross section as well as flow velocity is identical the same flow rate passes through only one jet channel. The height of the single jet channel having the same width than two symmetrically arranged jets may thus be doubled as compared to the two symmetrically arranged jets. The increased height of the jet channel also adds to the simpler construction because narrow jet channels are much harder to manufacture at similar precision.

Preferably the jet width exceeds the width of the warp of filaments by at least 2.5%, more preferably by at least 5% and most preferably by at least 10%.

The process according to the invention uses a linear elongated spinneret instead of a circular spinneret that comprises radially arranged orifices or a cluster of orifices over the area of the circle. A circular spinneret layout leads to inhomogeneous coagulating conditions for the plurality of filaments from the outer boundary of the filament cluster or radially arranged filaments to the center of the filament cluster or radially arranged filaments.

The spinneret orifices are arranged in rows and the positions of the orifices in each row are offset to the orifices of adjacent rows so as to provide a warp of uniformly spaced filaments.

The array of orifices may range from 1 to 25 rows, preferably from 3 to 15 rows, more preferably 3 to 10 rows. The spinneret orifices are spaced apart preferably with interspaces ranging from 0.4-1.5 mm and with the distance between adjacent orifices in one row being the same as the distance between orifices in adjoining rows thus forming a equilateral triangular pitch. In a preferred embodiment the number of orifices per row lies between 50 and 200.

The preferred coagulating liquids are aqueous solutions preferably water. The coagulating liquid is usually at an initial temperature of less than 20° C., preferably less than 10° C.

There is an upper limit to the jet flow. When the velocity in the jet is reaching spinning speed, tension before the deflection roll becomes so low that the yarn is not deflected anymore, but filaments go straight down. A deflection roll deflects the yarn direction from vertical to horizontal or vice versa. In a preferred embodiment of the process according to the invention the jetted coagulating liquid moves downward with the warp of filaments through the spin tube at a velocity of about 80% to 95% of the velocity of the filaments.

In another preferred embodiment of the process according to the invention the individual filaments have a linear density of 0.4 dtex to 10 dtex. The number of filaments spun by the process lies between 50 and 5000 filaments, more preferably between 500 and 2500 filaments.

The velocity of the filaments moving downwards through the spin tube preferably lies between 300 m/min and 2000 m/min, more preferably between 300 m/min and 1000 m/min.

The process according to the invention is especially advantageous if jetting liquid and/or washing liquid is partially or entirely reused by collecting and feeding it to the jet coagulator. The increased height of the jet channel as compared to symmetric jet layout leads to a decreased clogging risk.

It should be noted that the process according to the present invention is not limited to a single spinneret but also encompasses multiple spinnerets that run in parallel, e.g. on a spinning manifold.

The object of the present invention is also achieved with a process for producing a plurality of high strength, high modulus aromatic polyamide filaments comprising the steps of extruding an acid solution containing at least 15% by weight of an aromatic polyamide through a spinneret with orifices arranged in 1 to 10 ring shaped rows thus providing a filament bundle passing the filament bundle through a layer of non-coagulating fluid into a coagulation bath and subsequently passing the filament bundle through a spin tube, the spin tube having a ring shaped cross-section with an inner spin tube wall having an inner diameter and outer spin tube wall having an outer diameter jetting additional coagulating liquid at a constant flow rate about the filaments in a downward direction at an angle between 15° and 75° with respect to the filaments, the jetted coagulating liquid moving downward with the warp of filaments through the spin tube at a velocity of about 50% to 100% of the velocity of the filaments, the coagulating liquid being jetted through a jet channel, the jet channel being located either along the circumference of the outer spin tube wall or along the circumference of the inner spin tube wall.

The coagulating liquid in this layout is jetted about the filaments only on one side of the filaments and can therefore also be considered an asymmetrical jet configuration. Jetting is carried out from either the direction of the inner spin tube diameter or the outer spin tube diameter. The filaments are thus jetted against either the inner spin tube wall or the outer spin tube wall. However, the jet configuration is sufficient to envelop the individual filaments with coagulating liquid and to prevent sticking of the filaments to the spin tube wall as well as to other filaments.

In a preferred embodiment of this process the inner diameter of the spin tube is at least 4 mm, more preferably at least 6 mm and most preferably at least 12 mm.

The number of filaments spun by the above disclosed process is at least 250, preferably at least 500.

The present invention is explained in more detail with the following non limiting examples.

Spinning was carried out by extruding an acid solution of an aromatic polyamide through a spinneret consisting of 125 capillaries in 3 rows with a 1 mm triangular pitch. The spinning speed was 500 m/min. The velocity of the coagulating liquid in the spin tube below the jet was 80% of the spinning speed. Jet angle was 30°.

"Elongation at Break" (EAB) and "Breaking Tenacity" (BT) of the resulting yarn were measured according to ASTM D885-98.

The resulting yarn properties obtained by using a jet coagulator are given in comparison to a yarn obtained by the same equipment using the same acid solution of an aromatic Polyamide but no additional coagulating liquid was jetted about the filaments.

EXAMPLE I

Example I was carried out using an asymmetric jet layout with a jet height of 0.5 mm and a spin tube width of 1 mm. Table 1 shows the properties of the resulting yarn with and without jet.

TABLE 1

| | EAB % | BT mN/tex |
|---|---|---|
| Asymmetric jet coagulator | 3.11 | 2292 |
| Comparative example without jet | 3.31 | 2067 |
| Jet gain | −0.20 | +224 |

EXAMPLE II

Example II was carried out using a symmetric jet layout with two jets opposite to each other. The spin tube width was the same as in example 1, i.e. 1 mm. Since the same flow rate as in example 1 is now passed through two jets, the jet height was reduced to 0.25 mm in order to obtain the same velocity of the coagulating liquid in the spin tube. Table 2 shows the properties of the resulting yarn with and without jet.

TABLE 2

| | EAB % | BT mN/tex |
|---|---|---|
| Symmetric jet coagulator | 3.42 | 2230 |
| Comparative example without jet | 3.37 | 2069 |
| Jet gain | +0.05 | +161 |

EXAMPLE III

Example III was carried out using a symmetric jet layout with two jets opposite to each other. In this example the height of the jet was kept the same as in example I, i.e. 0.5 mm. Through each jet passed the same flow rate as in example 1. The flow rate in the spin tube was therefore doubled as compared to example 1. In order to obtain the same velocity of the coagulating liquid in the spin tube, the spin tube width was doubled to 2 mm. Table 3 shows the properties of the resulting yarn with and without jet.

TABLE 3

| | EAB % | BT mN/tex |
|---|---|---|
| Symmetric jet coagulator | 3.25 | 2355 |
| Comparative example without jet | 3.44 | 2134 |
| Jet gain | −0.19 | +221 |

An asymmetric jet layout leads to yarns with comparable or even better yarn properties than using a symmetric jet layout. Although example 3 led to basically the same gain in yarn properties as compared to example 1, the symmetric layout made a coagulating liquid flow rate necessary that was double as compared to the asymmetric jet layout.

The invention claimed is:

1. A process for producing a plurality of high strength, high modulus aromatic polyamide filaments, comprising the steps of:

extruding an acid solution containing at least 15% by weight of an aromatic polyamide through linearly arranged orifices in a spinneret to provide a warp of filaments;

passing the warp of filaments through a layer of non-coagulating fluid into a coagulation bath; and subsequently passing the warp through a spin tube, the spin tube having an elongated cross section with at least two opposite sides being parallel to the filament warp with a length of the at least two opposite sides being at least as long as a width of the filament warp;

jetting additional coagulating liquid at a constant flow rate about the filaments in a downward direction at an angle between 15° and 75° with respect to the filaments, wherein:

the jetted coagulating liquid moves downward with the warp of filaments through the spin tube at a velocity of about 50% to 100% of a velocity of the filaments, and the coagulating liquid is jetted through a jet channel from either side of the spin tube that is parallel to the filament warp, the jet channel having a width that is equal to or greater than the width of the filament warp.

2. The process according to claim 1, wherein the jetted coagulating liquid moves downward with the warp of filaments through the spin tube at a velocity of about 80% to 95% of the velocity of the filaments.

3. The process according to claim 1, wherein the filaments have a linear density of 0.5 dtex to 10 dtex.

4. The process according to claim 1, wherein the velocity of the filaments is between 300 m/min and 2000 m/min.

5. The process according to claim 1, wherein the coagulating liquid is partially or entirely reused by collecting and feeding it to the jet.

6. A process for producing a plurality of high strength, high modulus aromatic polyamide filaments, comprising the steps of:

extruding an acid solution containing at least 15% by weight of an aromatic polyamide through a spinneret with orifices arranged in 1 to 10 concentric ring shaped rows to provide a filament bundle;

passing the filament bundle through a layer of non-coagulating fluid into a coagulation bath; and subsequently passing the filament bundle through a spin tube, the spin tube having a ring shaped cross-section with an inner spin tube wall having an inner diameter and outer spin tube wall having an outer diameter;

jetting additional coagulating liquid at a constant flow rate about the filaments in a downward direction at an angle between 15° and 75° with respect to the filaments, wherein:

the jetted coagulating liquid moves downward with the warp of filaments through the spin tube at a velocity of about 50% to 100% of a velocity of the filaments, the coagulating liquid is jetted through a jet channel, and the jet channel is located either along a circumference of the outer spin tube wall or along a circumference of the inner spin tube wall.

7. The process according to claim 2, wherein the filaments have a linear density of 0.5 dtex to 10 dtex.

8. The process according to claim 2, wherein the velocity of the filaments is between 300 m/min and 2000 m/min.

9. The process according to claim 3, wherein the velocity of the filaments is between 300 m/min and 2000 m/min.

10. The process according to claim 7, wherein the velocity of the filaments is between 300 m/min and 2000 m/min.

* * * * *